US009580234B2

(12) United States Patent
Lam

(10) Patent No.: US 9,580,234 B2
(45) Date of Patent: Feb. 28, 2017

(54) PRODUCE CONTAINER WITH VENTILATION APERTURES

(71) Applicant: Multisteps Pty Ltd, Homebush West NSW (AU)

(72) Inventor: John Lam, Homebush West (AU)

(73) Assignee: Multisteps Pty Ltd., Homebush West NSW (AU)

( * ) Notice: Subject to any disclaimer, the term of this patent is extended or adjusted under 35 U.S.C. 154(b) by 0 days.

(21) Appl. No.: 14/706,332

(22) Filed: May 7, 2015

(65) Prior Publication Data

US 2015/0336734 A1 Nov. 26, 2015

(30) Foreign Application Priority Data

May 20, 2014 (AU) ..... 2014901878

(51) Int. Cl.

| | |
|---|---|
| ***B65D 85/34*** | (2006.01) |
| ***B65D 43/00*** | (2006.01) |
| ***B65D 81/26*** | (2006.01) |
| ***B65D 43/16*** | (2006.01) |

(52) U.S. Cl.

CPC ..... *B65D 85/34* (2013.01); *B65D 43/00* (2013.01); *B65D 43/162* (2013.01); *B65D 81/263* (2013.01)

(58) Field of Classification Search

CPC .... B65D 1/36; B65D 5/4295; B65D 21/0212; B65D 43/0204; B65D 43/16; B65D 43/162; B65D 75/22; B65D 75/245; B65D 81/26; B65D 81/263; B65D 85/34; B65D 2205/00; B65D 2205/02; B65D 2251/1033; B65B 25/04; Y10S 220/913; A61B 19/0256; A61B 19/026; A61B 19/0287

USPC .. 220/4.21–4.23, 366.1, 608, 671, 675, 780, 220/788, 810, 834, 836, 839, 913; 206/508, 509; 229/406, 902; D3/307; D7/629; D9/420, 423, 425–427

See application file for complete search history.

(56) References Cited

U.S. PATENT DOCUMENTS

| | | | | | |
|---|---|---|---|---|---|
| 5,069,344 | A | * | 12/1991 | Dehart | B65D 5/4295 206/508 |
| D361,511 | S | * | 8/1995 | Dickinson | D7/605 |
| 5,456,379 | A | * | 10/1995 | Krupa | B65D 43/162 206/508 |

(Continued)

FOREIGN PATENT DOCUMENTS

| | | | |
|---|---|---|---|
| AU | 2010100195 | A4 | 4/2010 |
| AU | 2010100641 | A4 | 7/2010 |
| EP | 1419978 | A2 | 5/2004 |

OTHER PUBLICATIONS

IP Australia, Innovation Patent Examination Report No. 1 for Application No. 2015101393, Nov. 24, 2015, 3 pages, Australia.

*Primary Examiner* — J. Gregory Pickett
*Assistant Examiner* — Brijesh V. Patel
(74) *Attorney, Agent, or Firm* — Alston & Bird LLP

(57) ABSTRACT

The present invention relates to a produce container which includes lid and a receptacle associated with the lid. The receptacle has four wall portions and a base. Each wall portion is connected to the base by a transition portion with one or more elongate apertures. The or each elongate aperture is configured and orientated such that its length is parallel to a longitudinal length of the transition portion in which the or each aperture is located.

6 Claims, 7 Drawing Sheets

(56) References Cited

U.S. PATENT DOCUMENTS

| | | | | | |
|---|---|---|---|---|---|
| 5,947,321 | A * | 9/1999 | Vadney | B65D 51/1611 | 220/326 |
| D419,375 | S * | 1/2000 | Mangla | D7/387 | |
| D573,015 | S * | 7/2008 | Chen | D9/425 | |
| 8,167,166 | B2 * | 5/2012 | Kidd | B65D 43/162 | 220/326 |
| 2003/0152670 | A1 * | 8/2003 | Shih | B65D 43/162 | 426/106 |
| 2006/0289550 | A1 * | 12/2006 | Guardigli | B65D 1/42 | 220/810 |
| 2007/0007293 | A1 * | 1/2007 | Sambrailo | B65D 1/22 | 220/366.1 |
| 2008/0135556 | A1 * | 6/2008 | Bontrager | B65D 1/34 | 220/260 |
| 2011/0233077 | A1 * | 9/2011 | Cadiente | B65B 25/04 | 206/204 |
| 2012/0138501 | A1 * | 6/2012 | Lam | B65D 25/205 | 206/459.5 |
| 2012/0312820 | A1 * | 12/2012 | Cadiente | B65D 21/0219 | 220/367.1 |
| 2013/0220855 | A1 * | 8/2013 | Markovitch | A61B 19/0287 | 206/363 |

* cited by examiner

PRODUCE CONTAINER WITH VENTILATION APERTURES

CROSS REFERENCE TO RELATED APPLICATIONS

This application claims priority to Australian Provisional Patent Application No. 2014901878, filed May 20, 2014, the contents of which as are hereby incorporated by reference in their entirety.

BACKGROUND

Technical Field

The present invention relates to packaging containers. More particularly, the present invention relates to a produce container with ventilation apertures.

Description of Related Art

There is a need for produce growers and traders to use produce containers, to transport fresh produce from farms to distributors or wholesalers who would then on-sell the produce to retailers for selling to the general public. Typically, the produce is packed in a large number of containers arranged in stacks which are fitted into a plastic tray for transportation.

It is generally desired in the produce packaging industry to provide a container which allows the produce to be aerated before consumption in order to prevent any premature deterioration of the produce within the container.

It is commonplace to provide apertures in produce containers so as to facilitate ventilation. Existing apertures, such as those shown in Australian innovation patent number 2010100641, however have the disadvantage in that they can easily cause damage to the produce which unavoidably rubs against them during transportation. Also, as shown in the drawings of Australian innovation patent number 2010100641, the apertures are typically provided along a portion joining the side wall and floor of a produce container. Such apertures are so configured and orientated that they have the disadvantage of somewhat weakening the integrity of the portion joining the wall and floor of a container.

It is an object of the present invention to provide a produce container which may overcome or ameliorate the above shortcomings, or which will at least provide a useful alternative.

BRIEF SUMMARY

According to the present invention, there is provided a produce container including:

a lid; and a receptacle associated with the lid, the receptacle having four wall portions and a base, each wall portion being connected to the base by a transition portion with one or more elongate apertures;

wherein the or each elongate aperture is configured and orientated such that its length is parallel to a longitudinal length of the transition portion in which the or each aperture is located.

Preferably, the transition portion is bevelled.

In a preferred embodiment, one or more of the transition portion has three apertures which are spaced apart from one another. Preferably, one or more of the transition portion has two apertures. More preferably, the or each aperture is provided in a raised section.

It is preferred that a gap is provided between adjacent raised sections.

BRIEF DESCRIPTION OF THE FIGURES

The invention may be better understood from the following non-limiting description of a preferred embodiment, in which.

DETAILED DESCRIPTION OF VARIOUS EMBODIMENTS

Figure 1:
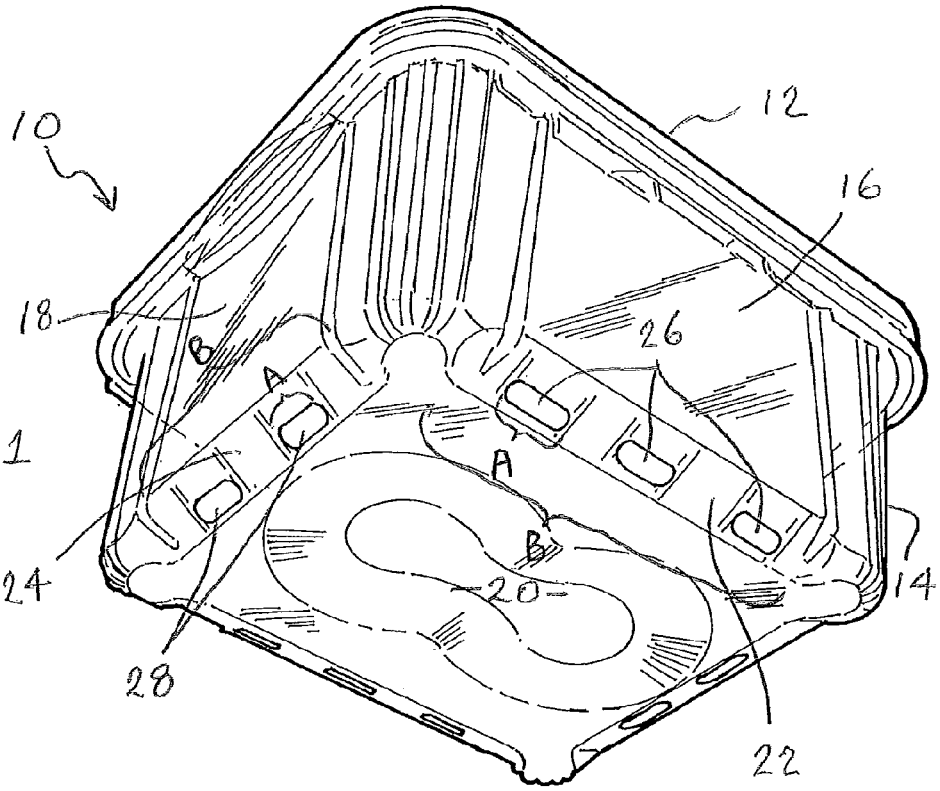
FIG. 1 is a perspective view from bottom of a produce container in a closed state in accordance with the preferred embodiment of the present invention.
Figure 2:
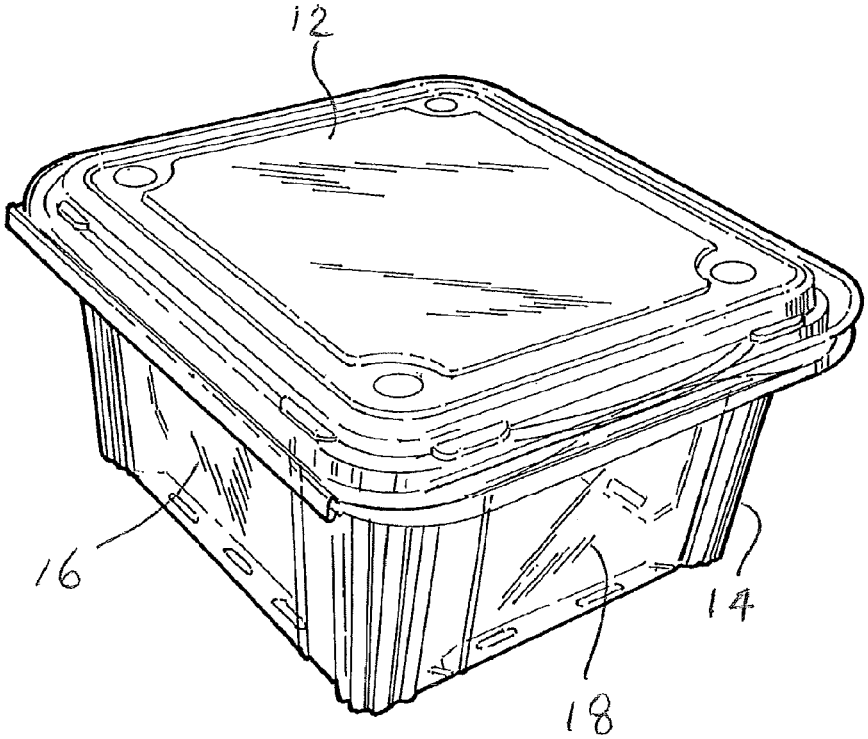
FIG. 2 is a perspective view from top of the produce container of FIG. 1 in a closed state.
Figure 3:
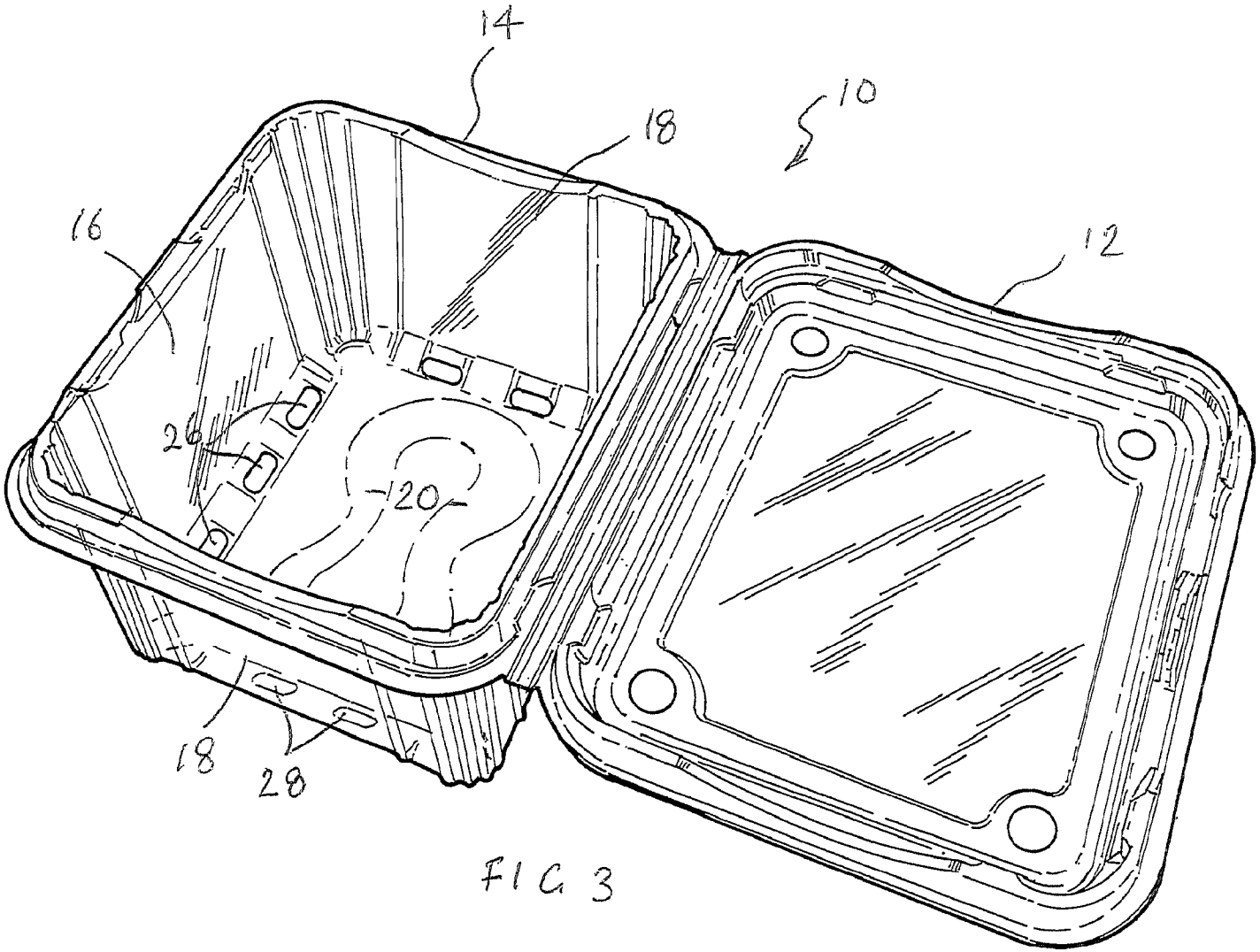
FIG. 3 is a perspective view from top of the produce container of FIG. 1 in an open state.
Figure 4:
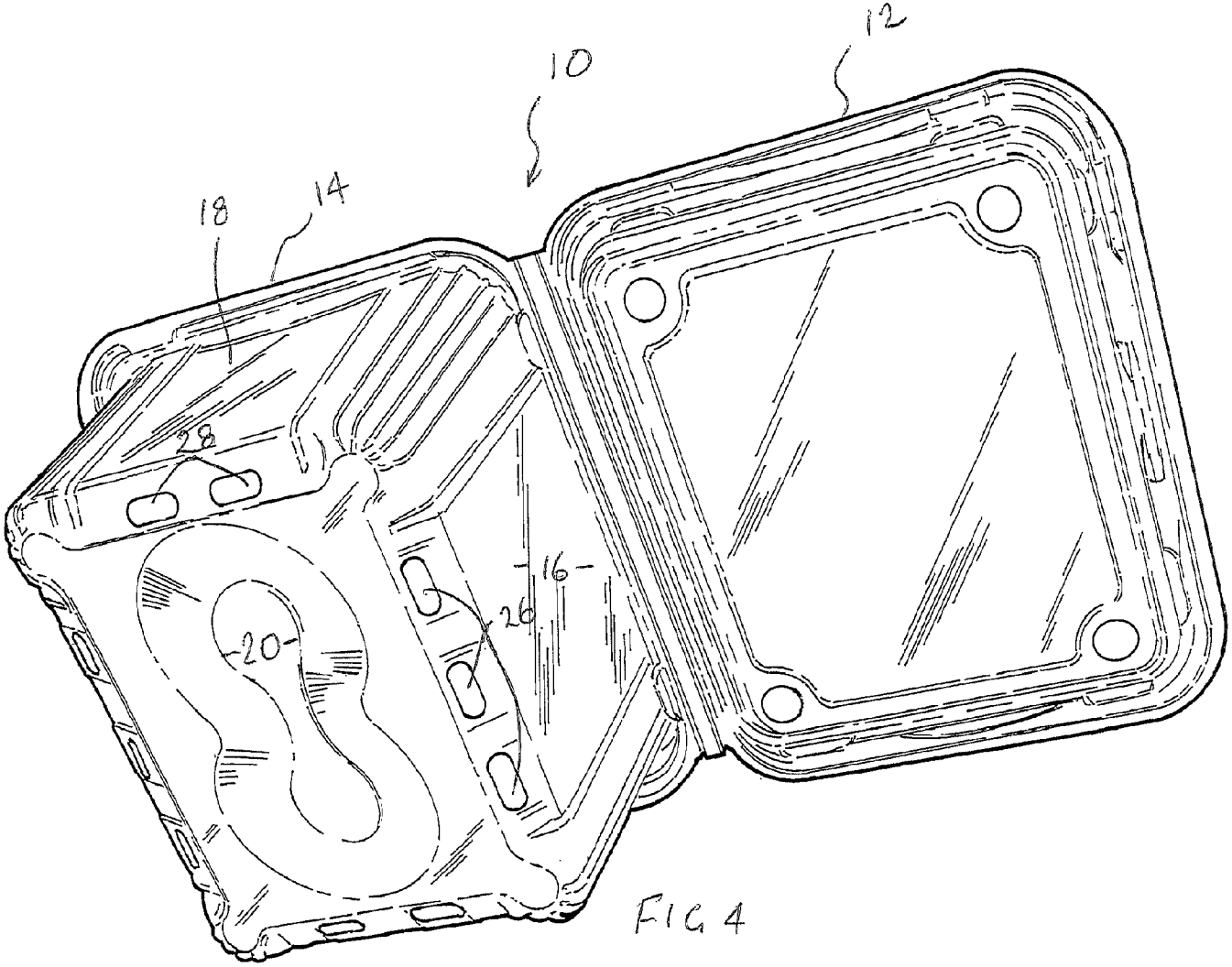
FIG. 4 is a perspective view from bottom of the produce container of FIG. 1 in an open state.

Referring to FIGS. 1 to 9, a produce container 10 is shown including a lid 12 and a receptacle 14 hinged to the lid 12. The receptacle 14 has four wall portions 16 & 18 and a base 20.

As best shown in FIGS. 1, 4 & 6 to 9, each of the wall portions 16, 18 is connected to the base 20 by a bevelled transition portion 22, 24. The transition portions 22 has three elongate apertures 26 whereas transition portions 24 has two elongate apertures 28. The apertures 26 & 28 are spaced apart along the respective transition portion 22 & 24. Each of the elongate apertures 26, 28 is configured and orientated such that its length indicated by A is parallel to a longitudinal length indicated by B of the bevelled transition portion 22, 24 in which the aperture 26, 28 is located. For example, the length A of aperture 26 is parallel to the length B of transition portion 22.

Figure 5:
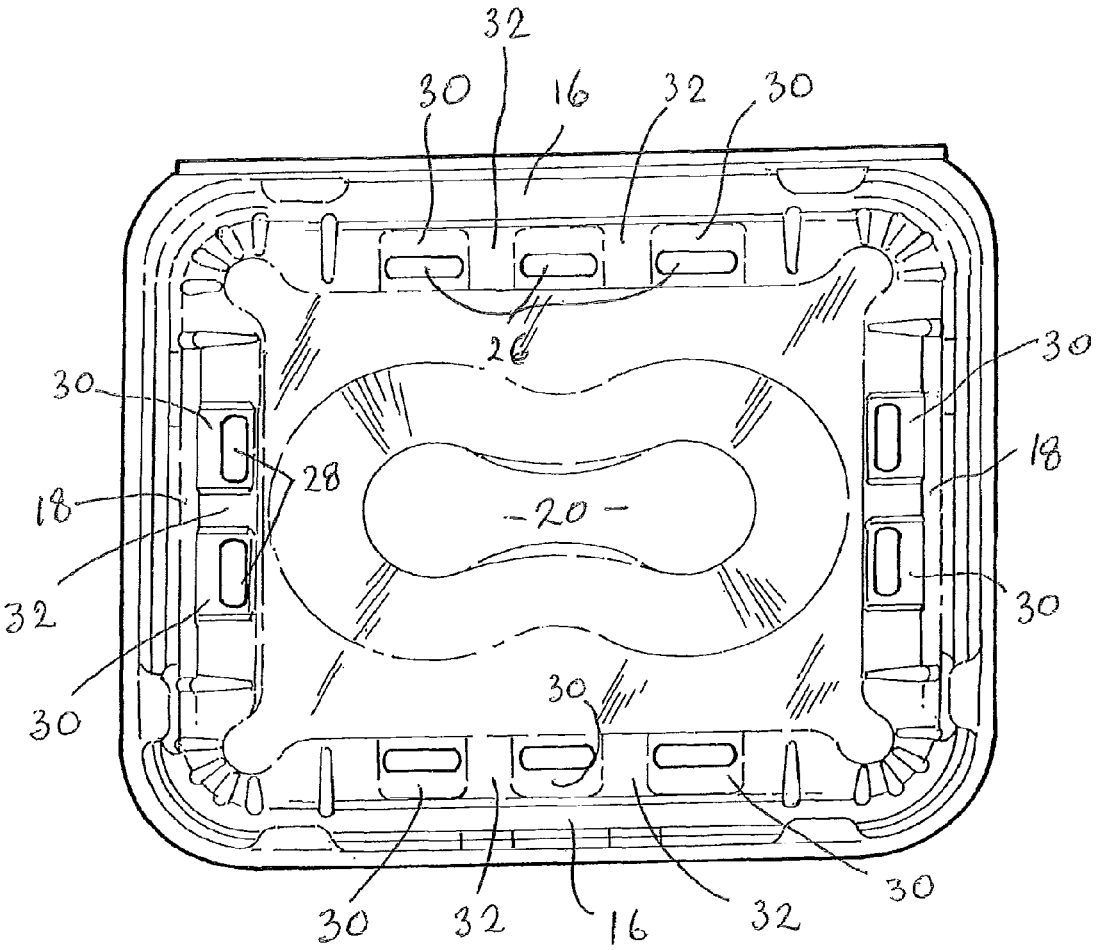
FIG. 5 is a plan view from bottom of the produce container of FIG. 1.
Figure 6:
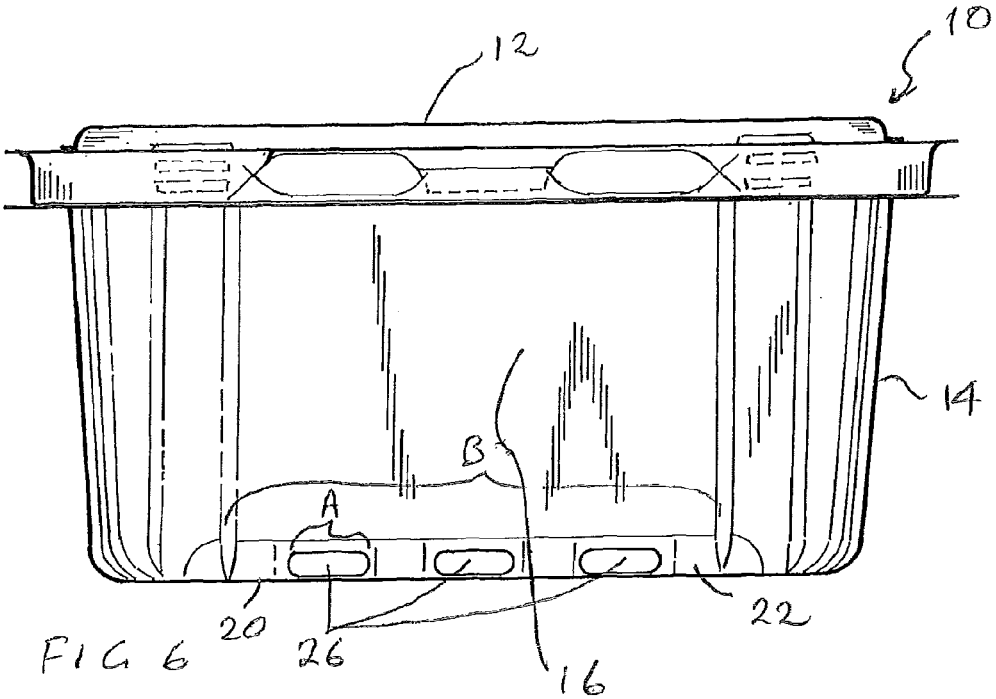
FIG. 6 is a front elevation of the produce container of FIG. 1.
Figure 7:
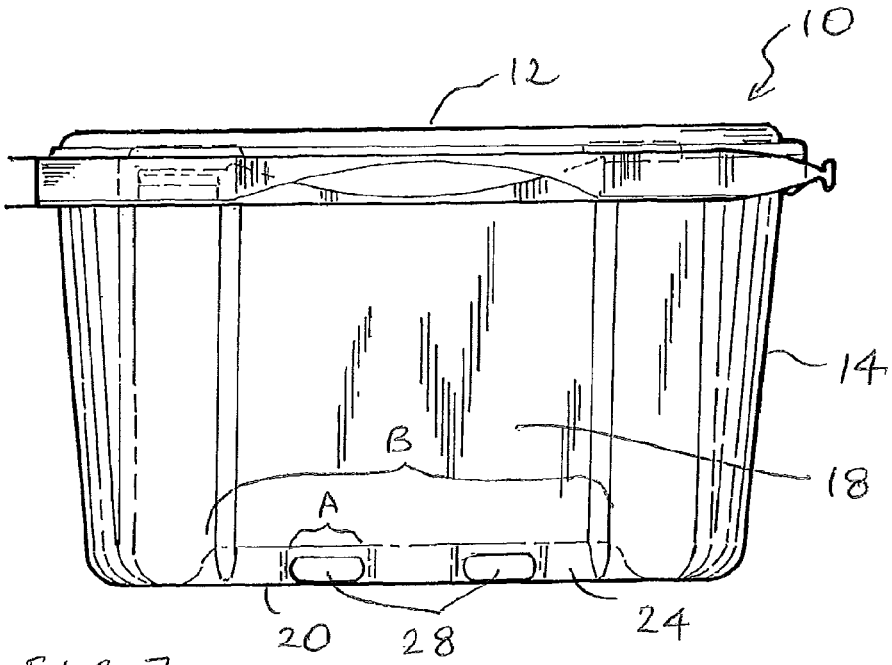
FIG. 7 is one side view of the produce container of FIG. 1.
Figure 8:
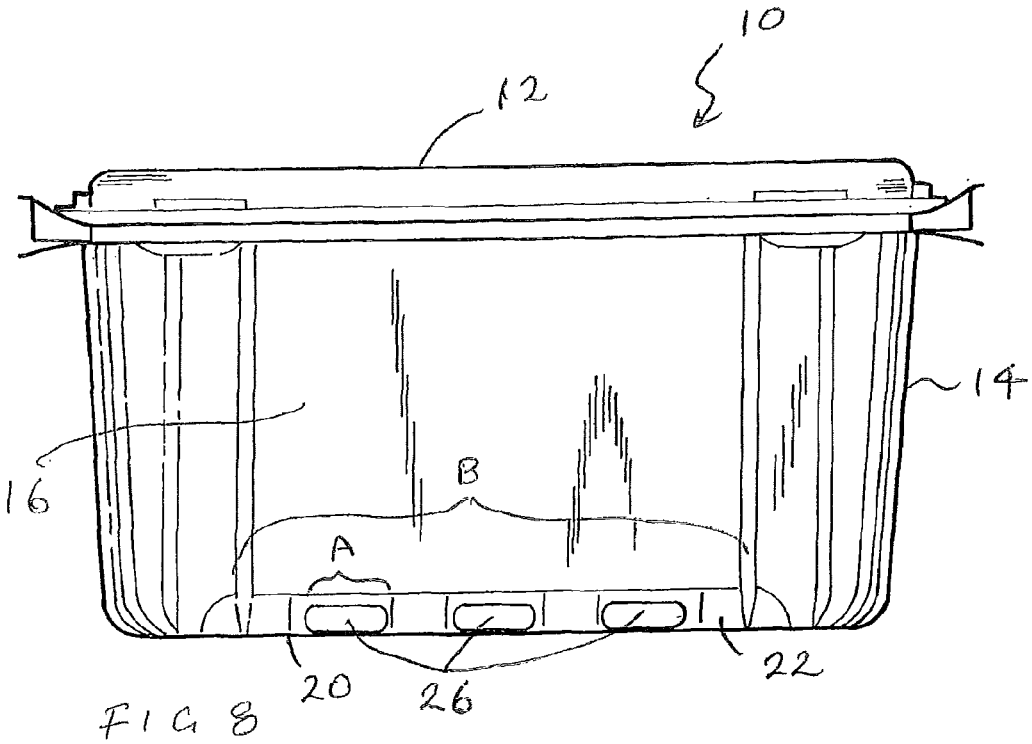
FIG. 8 is a rear elevation of the produce container of FIG. 1.
Figure 9:
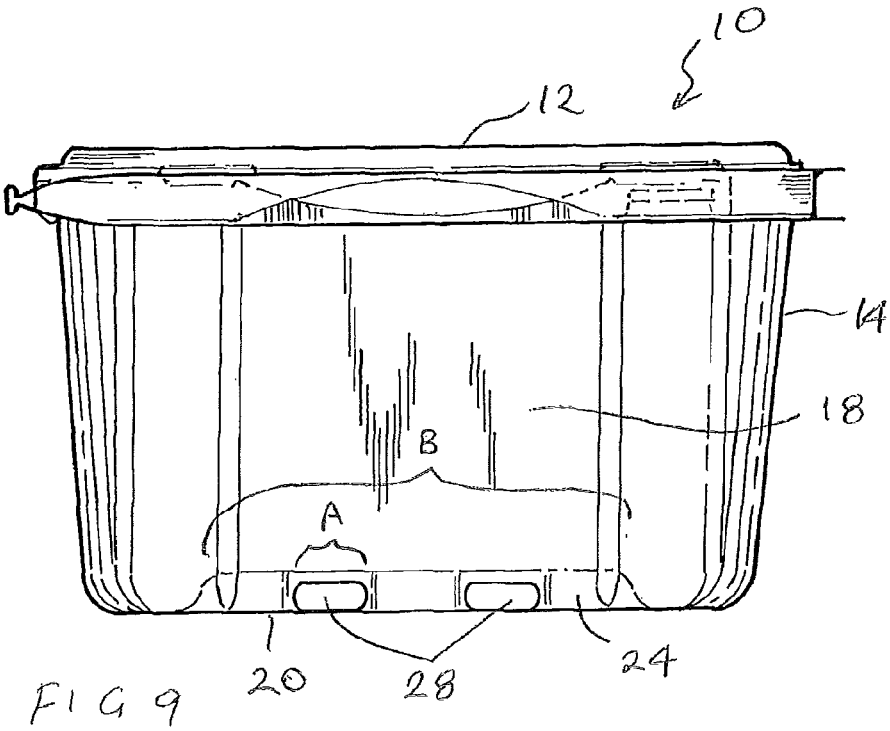
FIG. 9 is another side view of the produce container of FIG. 7.

As shown in FIG. 5, each aperture 26, 28 is provided in a raised section 30. A gap 32 is provided between adjacent raised sections 30. The raised sections 30 function as reinforcements thereby rendering the respective bevelled transition portions 22 & 24 stronger and more sturdy. This is advantageous in that the strengthen transition portions 22 & 24 would prevent the container 10 from failing and the produce from being crushed.

Figure 10:
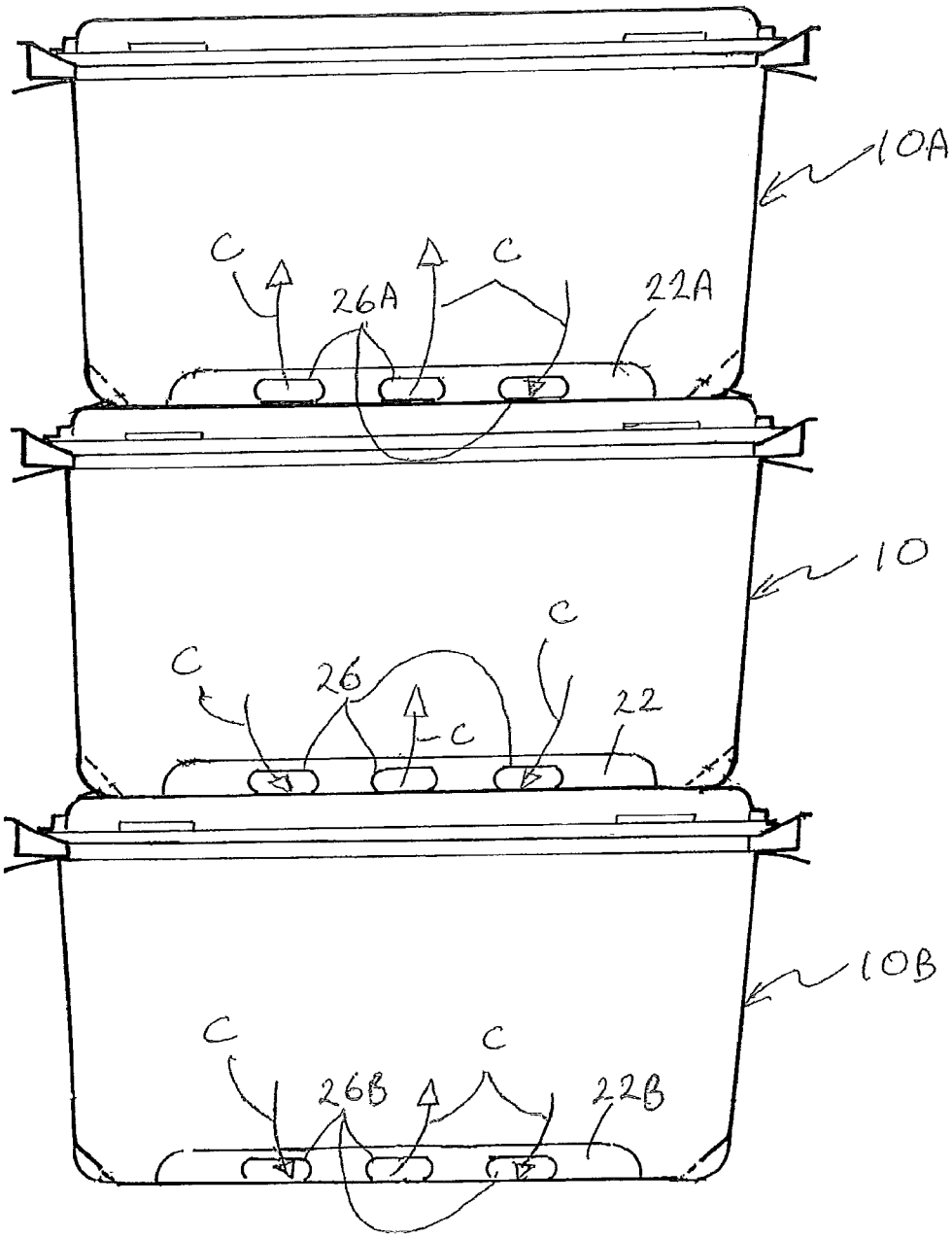
FIG. 10 is a front elevation of the produce container of FIG. 1 being stacked between two other identical produce containers.

Turning to FIG. 10, the produce container 10 is stacked in between two other identical produce containers 10A & 10B. It can be seen that the apertures 26, 26A & 26B are provided on bevelled transition portions 22, 22A & 22B respectively. As such, the produce inside the containers 10, 10A & 10B are well ventilated with random air flow in different directions as indicated by arrows C. It is important to note that the apertures 26, 26A and 26B have considerably sharp edges. However, given their configuration and orientation, the apertures 26 & 28 are unlikely to cause damage to produce such as strawberries and tomatoes even in circumstances where the strawberries and tomatoes are urged against the apertures 26 & 28 after packing.

Now that a preferred embodiment of the present invention has been described in some detail, it will be apparent to a skilled person in the art that the produce container of the present invention may offer at least the following advantages:

1. it prevents or at least minimises the risk of the produce being damaged by the sharp edges of the apertures; and
2. it offers enhanced integrity and hence reduces the likelihood of the produce being crushed, bruised or otherwise damaged.

Those skilled in the art will appreciate that the invention described herein is susceptible to variations and modifications other than those specifically described. All such variations and modifications are to be considered within the scope and spirit of the present invention the nature of which is to be determined from the foregoing description.

That which is claimed:

1. A produce container including:

a lid; and a receptacle associated with the lid, the receptacle having four wall portions and a base, each wall portion being connected to the base by a transition portion located intermediate each wall portion and the base, the transition portion containing one or more elongate apertures;

wherein:

each of the one or more elongate apertures is configured and orientated such that a longitudinal length of each of the one or more elongate apertures is parallel to a longitudinal length of the transition portion in which each of the one or more elongate apertures is located;

each of the one or more elongate apertures is wholly contained within the transition portion;

each of the one or more elongate apertures is wholly contained within a substantially rectangular-shaped raised section of the transition portion, each of the substantially rectangular-shaped raised sections having a width substantially equal to a width of the transition portion and a length greater than the longitudinal length of each of the one or more elongate apertures; and an unraised gap is provided between each adjacent substantially rectangular-shaped raised section of the transition portion.

2. The produce container of claim 1, wherein the transition portion is beveled.

3. The produce container of claim 1, wherein the transition portion has three apertures spaced apart from one another.

4. The produce container of claim 1, wherein the transition portion has two apertures.

5. The produce container of claim 1, wherein each of the substantially rectangular-shaped raised sections has a length that is longer than the width of the substantially rectangular-shaped raised section, the length defining a long side of the substantially rectangular-shaped raised section, the long side being parallel to the longitudinal length of a corresponding one of the one or more elongate apertures.

6. The produce container of claim 1, wherein each of the one or more elongate apertures is offset within each of the corresponding substantially rectangular-shaped raised sections.

* * * * *